US005971150A

United States Patent [19]

Anderson et al.

[11] Patent Number: 5,971,150

[45] Date of Patent: Oct. 26, 1999

[54] PAPERBOARD CONTAINER HAVING SUPPORT CAPABILITY FOR ROLL MATERIALS

[75] Inventors: Robert Arnel Anderson, White Bear Lake; Arnold Nels Anderson, North St. Paul, both of Minn.

[73] Assignee: Norflex, Inc., Hudson, Wis.

[21] Appl. No.: 08/840,600

[22] Filed: Apr. 22, 1997

[51] Int. Cl.[6] ..... B65D 85/66; B65D 85/672

[52] U.S. Cl. ..... 206/389

[58] Field of Search ..... 206/389, 393, 206/394, 395, 396, 397, 415, 493

[56] References Cited

U.S. PATENT DOCUMENTS

| | | | |
|---|---|---|---|
| 1,866,130 | 7/1932 | Reichel | 206/389 |
| 1,905,561 | 4/1933 | Gluck | 206/389 |
| 2,293,187 | 8/1942 | Becker | 206/389 |
| 2,864,493 | 12/1958 | Holcombe | 206/389 |
| 3,246,742 | 4/1966 | Coe | 206/396 |
| 3,530,980 | 9/1970 | Link | 206/394 |
| 4,298,123 | 11/1981 | Roccaforte et al. | 206/396 |
| 5,141,108 | 8/1992 | Roccaforte | 206/396 |

*Primary Examiner*—Paul T. Sewell
*Assistant Examiner*—Anthony Stashick
*Attorney, Agent, or Firm*—Schwegman, Lundberg, Woessner & Kluth, PA

[57] ABSTRACT

The present invention relates to a single paperboard sheet of material which can be folded upon itself to form a container which can support in its interior material to be provided in roll form with a supporting core. The sheet comprises four major wall panels which are aligned in a row with a major flap insert panel, each of the major wall panels having a pair of minor side wall panels aligned with minor side edges of the major wall panels, at least three of the of the major wall panels having pairs minor side panels aligned at minor side edges with holes therein, with at least two adjacent pairs of minor side panels and the major side panels most distant from each other having holes therein. This sheet may be folded upon itself to provide a self-supporting carton with holes in opposite minor side panels which can support a core or a roll of material on a core. Internal locking pieces may be provided so that no stapling or gluing of the panels is needed to secure the carton together.

18 Claims, 2 Drawing Sheets

PAPERBOARD CONTAINER HAVING SUPPORT CAPABILITY FOR ROLL MATERIALS

BACKGROUND OF THE INVENTION

1. Field of the Invention

The present invention relates to paperboard containers, and more particularly to paperboard containers which are used to protect materials provided in roll form, such as stretch wrap, wall-paper, and the like.

2. Background of the Art

Paperboard containers are desirable packaging materials for the shipping and protection of goods because they meet many industrial needs. They are lightweight, relatively strong, easily manufactured, recyclable, and are relatively inexpensive. Paperboard packaging can also be easily designed to provide specific additional functions to the final packaging structure, such as handles, spouts, and the like. The preconstructed sheet of paperboard can also be itself shipped as a unitary sheet for use by a purchaser with little expectation of damage to the preconstructed container prior to its end use. For example, U.S. Pat. No. 5,531,376 describes a unitary paperboard sheet which may be folded upon itself to form a paperboard container with a pour spout. The container comprises a number of different panels on a single sheet of paperboard which can be folded into a container with a pour spout as an integral section of the original sheet and the final container. This can avoid the need for special tools or materials when the end user places materials into the final assembled container.

BRIEF DESCRIPTION OF THE INVENTION

The present invention relates to a single paperboard sheet of material which can be folded upon itself to form a container which can support in its interior material to be provided in roll form with a supporting core. The sheet comprises four major wall panels which are aligned in a row with a major flap insert panel, each of the major wall panels having a pair of minor side wall panels aligned with minor side edges of the major wall panels, at least three of the major wall panels having pairs minor side panels aligned at minor side edges with holes therein, with at least two adjacent pairs of minor side panels and the major side panels most distant from each other having holes therein. This sheet may be folded upon itself to provide a self-supporting carton with holes in opposite minor side panels which can support a core or a roll of material on a core. Internal locking pieces may be provided so that no stapling or gluing of the panels is needed to secure the carton together. A container blank can be folded to form a container designed to support material wrapped upon a core with ends of the core extending beyond edges of said material, the container blank comprising:

a. four rectangular major faces, comprising in order a first panel, second panel, third panel and fourth panel, each panel being foldably secured to the next adjacent panel, b. each of the four major face panels has a pair of panels at opposite ends of said major face panels, comprising in order a first pair of side panels, a second pair of side panels, a third pair of side panels and a fourth pair of side panels, c. the first pair of side panels being foldably attached to the first major face panel, but being separated or separable from each adjacent member of said second pair of side panels, d. said second pair of side panels being separable or separated from the second major face panel and foldably attached to each adjacent panel in the third pair of side panels, e. the third pair of side panels are foldably attached to the third major face panel and to said fourth pair of side panels, f. the fourth pair of side panels being separable or separated from the fourth major face panel, and g. an edge of the fourth major face panel farthest away from said first major face panel having a foldably attached closing panel attached thereto, at least the first, third and fourth pairs of side panels having openings or openable sections therein.

DETAILED DESCRIPTION OF THE INVENTION

Figure 1:
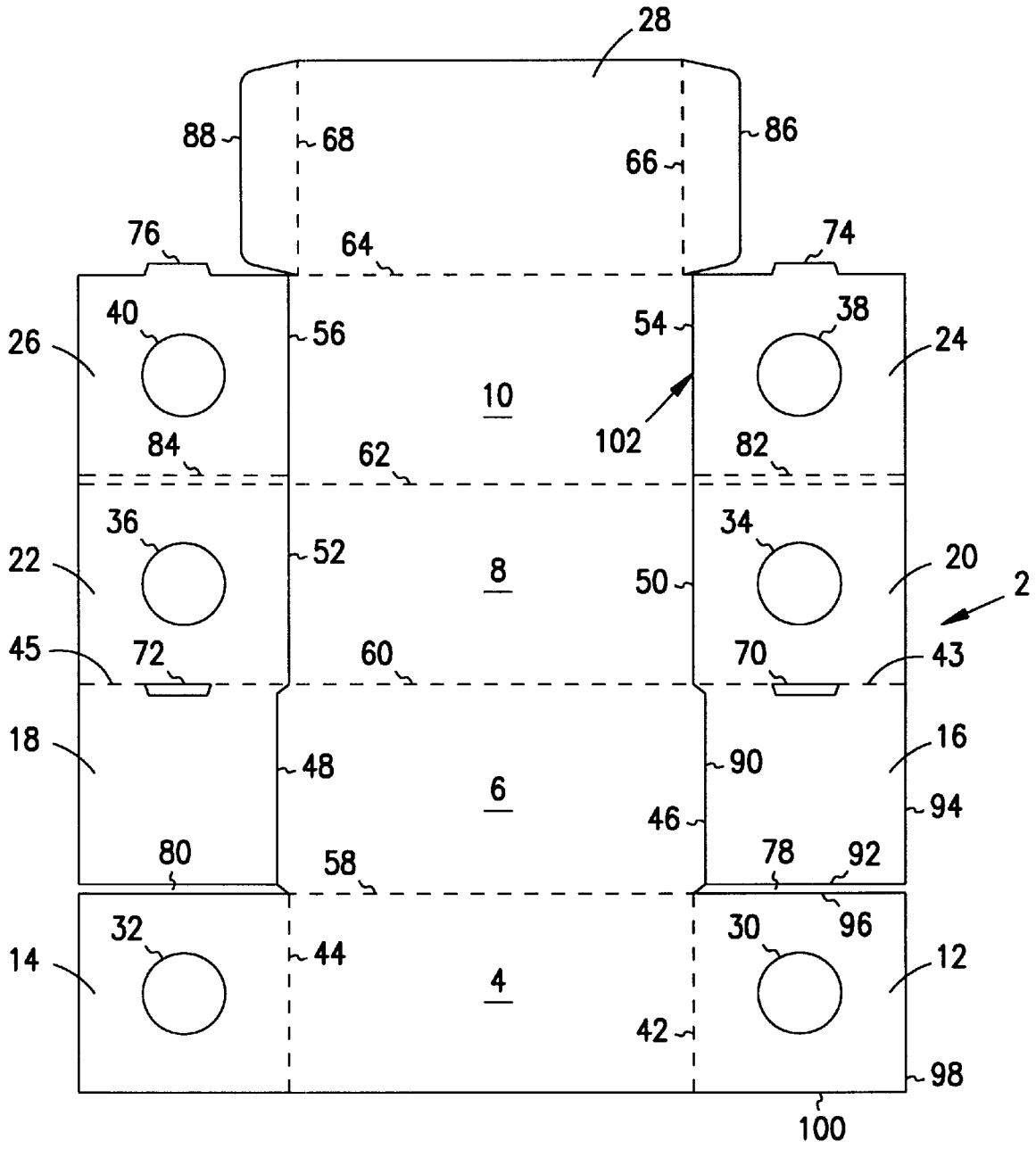
FIG. 1 shows a single sheet, pre-assembled container according to the present invention.

The present invention describes a preassembled and assembled paperboard container for the carrying of materials, particularly materials supported on a core and/or wrapped upon a core. The container comprises structural paperboard, e.g. cardboard, corrugated paper or paperboard which preferably can withstand at least fifty pounds per square inch stable force without tearing within 1 minute (referred to a fifty pound test paper), preferably at least 100 pound test paper, more preferably at least 150 pound test paper, and most preferably at least 175 or at least 200 pound test paper. The design of the container and the sheet used to make the container can best be understood by reference to FIG. 1. The weight of the paper necessary to effect these test weights may vary with the construction of the paper. With corrugated paper, for example, the paper must be about 30% (in weight units per 1000 ft.$^2$) to meet the equivalent force standards. That is, to be at least 50 pounds test value paper, the weight of the paper should probably be at least 16 pounds per 1000 ft.$^2$. Similarly, to be at least 100 pounds test, the paper should weight at least about 33 pounds per ft.$^2$, and to be at least 250 pounds test paper, the weight should be at least 70 pounds per ft.$^2$ for corrugated paper or cardboard.

FIG. 1 shows the most preferred pre-assembled container blank 2 used in the practice of the present invention. The blank 2 comprises four major face panels 4, 6, 8 and 10. Each of these major face panels 4(herein referred to as the first panel 4), 6(herein referred to as the second panel 6), 8 (herein referred to as the third panel 8) and 10 (herein referred to as the last panel 10) have two minor side panels 12, 14 and 16, 18 and 20, 22 and 24, 26, respectively associated therewith. The minor side panels 12, 14 and 16, 18 and 20, 22 and 24, 26 are respectively approximately or exactly in line with the major side face panels 4, 6, 8 and 10 with which they are respectively associated. The last panel 10 has a closing flap panel 28 attached thereto, distal from the first panel 4. On the major face panels 4, 8, and 10, the minor side panels 12, 14 and 20, 22 and 24, 26, respectively associated therewith have holes cut therein 30, 32, 34, 36, 38 and 40 cut therein. The blank 2 may be provided for pre-assembled shipping with the holes 30, 32, 34, 36, 38 and 40 plugged or serrated (not shown), but the capability of holes should exist or they otherwise would have to be cut by the assembler. The respective pairs of minor side panels 12, 14 and 16, 18 and 20, 22 and 24, 26, beginning with the first pair 12 and 14 are preferably associated into the blank 2 as follows:

Minor side panels 12 and 14 are attached by foldable lines 42, 44 respectively to major face panel 4. Minor side panels 16 and 18 are attached by foldable lines 43 and 45 to adjacent minor side panels 20 and 22, with a separation 78 and 80 between minor side panels 12 and 14 and minor side panels 16 and 18. The separations 78, 80 may initially be provided as partial cuts (not show) rather than the complete cut or separation 78, 80 shown in FIG. 1.

Minor side panels 20, 22 are, as already noted, attached to minor side panels 16 and 18, respectively, and are also attached by foldable lines 50 and 52, respectively to major face panel 8. There are fold lines, and preferably double ridge fold lines 82 and 84 between minor side panels 20 and 22 and the next adjacent set of minor side panels 24 and 26. Minor side panels 24 and 26 are respectively attached by foldable lines 54 and 56 to major face panel 10.

FIG. 1 shows that three pairs of minor face panels 12, 14 and 20, 22 and 24, 26 have holes 30, 32, 34, 36, 38 and 40 therein. These holes will eventually be located on outwardly facing side walls (not shown in this Figure) on the assembled container (not shown in this Figure). Minor side panels 16 and 18 are shown without any holes therein. That is because these minor side panels 16 and 18 will lay within the assembled container along an interior surface of a major face panel 6 when the container is completely constructed. Therefor a hole is unnecessary in these panels 16, 18, but may be present if desired.

The last major face panel 10 preferably has another panel as a major flap insertion panel 28 attached to it by a foldable line 64. The major flap panel 28 has dimensions approximately those of the major face panels 4, 6, 8 and 10, but generally should be slightly smaller in one or both surface dimensions than the major face panels 4, 6, 8 and 10 to enable easy insertion yet additional support for the element during and after assembly. The major flap panel 28 also preferably has minor flap insertion panels 86 and 88 attached by foldable lines 66 and 68 to the major flap panel 28.

An additional preferred embodiment of the invention provides locking flaps or locking inserts 74 and 76 (or only one such locking insert) on an edge of the minor side panels 24 and 26 for securing the container after it has been assembled. These locking inserts 74 and 76 will be secured to slots 70 and 72 which are cut into folding lines 43 and 45 between minor side panels 16 and 18, and 20 and 22, respectively. It is preferred that the center of slots 70 and 72 be located within the second minor side panels 16 and 18. The four major face panels 4, 6, 8, and 10 are attached to each other by foldable lines 58, 60 and 62.

Assembly of the container will be described with respect to the blank 2 by referencing only one side of the container blank 2, but a parallel operation will occur on the other side of the container blank 2. The operation of assembly does not have top proceed with the specific ordering of steps described below, but steps may be rearranged within obvious physical limitations (e.g., locking insert 74 can not be inserted into slot 70 until minor side panel 16 has been folded along line 46).

Assembly of the container blank 2 may proceed as follows. Minor side panel 20 is moved by folding along line 50, which also moves minor side panels 24 and 16 out of planarity with major face panel 8. Minor side panel 16 has an edge 90 placed approximately into contact with, or adjacent to, or parallel with fold line 60. Edge 92 faces inwardly, and edge 94 faces away from major face panel 8. Major face panel 6 is lifted or rotated by folding along line 60. This has the effect of also elevating major face panel 4 and minor side panel 12, with minor side panel 12 now being moved over edge 94 by sliding edge 96 over edge 94. Edge 98 then move into contact with major face panel 8 with holes 30 and 34 now in alignment. Minor side panel 16 is pressed against major face panel 8. Minor face panel 24 is then folded along line 82 over edge 100. The double fold line for line 82 is now more apparent in its preference as the fold along line 82 can be seen to overlay the entire thickness of the edge 100 of minor side face 12. This fold along line 82 places holes 30, 34 and 38 into alignment. Major face panel 10 is then moved by folding along line 62 and this action also moves insert panel 28 which may be further directed by folding along line 64. Flap insertion panels 86 and 88 may also be folded along lines 66 and 68 at this time. The container is fairly well supported now by tension and friction between various edges and faces (not specifically identified) which are in contact with each other. When minor face panel 24 is folded along line 82, locking insert 74 may be inserted into slot 70 to provide greater security (less movement) within the container structure. As the major face panel 10 is moved into position, its edge 102 overlays the fold line 82, and insert panel 28 is slid into the existing structure so that insert panel 28 moves into nearly planar parallel position with major face panel 4, with flap insertion panels 86 and 88 moving into nearly planar parallel position with minor side panels 12, 20 and 24. This essentially completes the method of assembling the container from the blank 2.

The types of materials which would be packaged in the assembled container of the present invention would be any material which is provided in a rolled manner, especially when rolled upon a core. Of particular interest to the practice of the present invention is the packaging of materials which are fed from a roll, and most importantly materials on a core in rolled presentation which have a tendency to telescope along the core. As is well known in many industries, such as wallpaper, stretch wrap, shrink wrap, film base, photographic film, and other fields using sheet materials, the contacting surfaces between a sheet which is wrapped upon itself may have a significant tendency to slide or move. When this occurs in a material wrapped upon a core, the extension of the sheet material along a path parallel to the axis of the core which moves various layers of the sheet material out of alignment is termed "telescoping" because the material extends in a line parallel to the axis of the core very much in a manner like the normal operation of a telescope. This is a very undesirable even in most circumstances, at least for the very reason that the extended edges of the sheet material are subject to bending, creasing, cutting, or other exposure to damage. The present invention provides a means for significantly reducing telescoping and damage to wrapped goods from telescoping.

Figure 2:
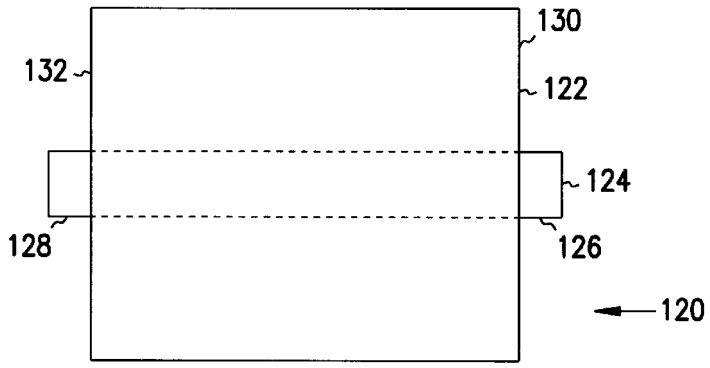
FIG. 2 shows a roll of material which is to be accried by an assembled container according to the practice of the present invention.

FIG. 2 shows a product 120 comprising sheet material 122 wrapped about a core 124. The ends 126 and 128 of the core 124 extend beyond the ends 130 and 132 of the sheet material 122. These ends 126 and 128 would be inserted or positioned within the assembled container of the present invention so that the edges 130 and 132 of the sheet material 122 would be supported against inside surfaces of the container. This provides not only general structural support to the container, but also clearly reduces the potential for telescoping. This is shown more clearly in FIG. 3.

Figure 3:
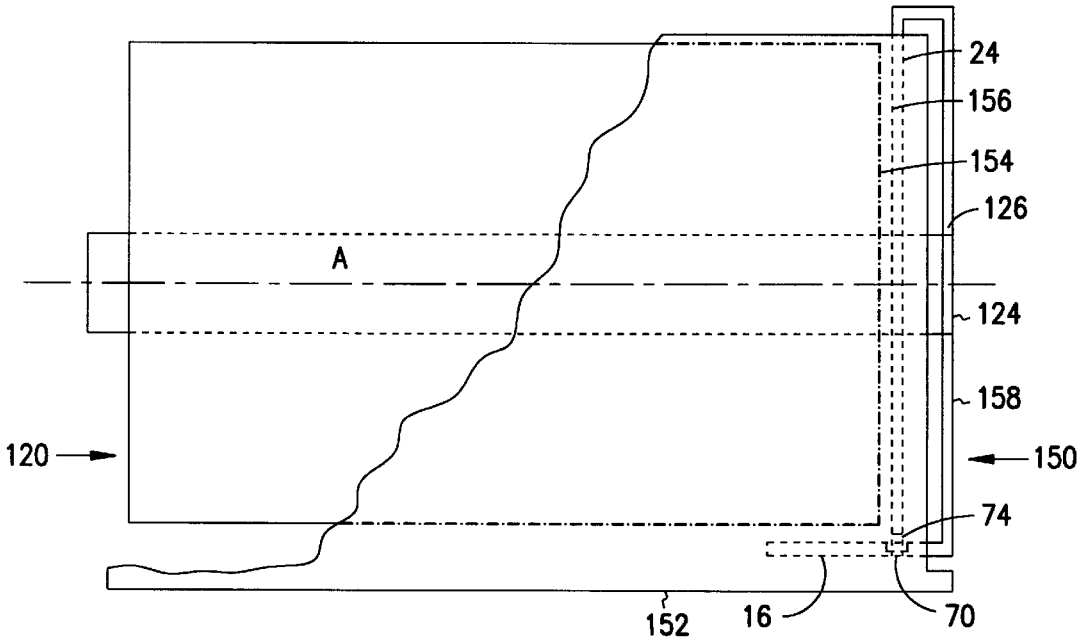
FIG. 3 shows a cut-away view of an assembled container of the present invention supporting a roll of material on a core.

FIG. 3 shows a cut-away view of a fully loaded and assembled container 150 of the present invention. A product 120 as in FIG. 2 is within the container frame 152 itself. An end 126 of the core 124 is supported within the frame 152. A face or side 154 of the sheet material 122 abuts the surface of minor end panel 24. The end 126 of the core 124 lie securely within the aligned holes 30, 34 and 38 from FIG. 1, but not shown in this FIG. 3. The end 126 of the core 124 may or may not extend up to or beyond the most exterior face 158 of the assembled container 150 which corresponds to minor end panel 20. Locking flap panel 74 is shown inserted into slot 70 in minor end panel 16 to secure the container without adhesive. Because the side 154 is securely supported against an interior face 156 of the assembled container 150, the sheet material 122 does not have freedom of movement parallel to the axis A of the core 124, and the sheet material 122 at all various heights (not specifically identified) away from the core 122 cannot shift, slide or telescope in a direction parallel to an axis A of the core 124. The simple construction of the container and the blank thereby solves numerous needs of the packaging industry for protecting and carrying rolled sheet material in cardboard containers.

The packaging of the present invention may also be described as a container blank which can be folded to form a container designed to support material wrapped upon a core with ends of the core extending beyond edges of said material comprising:

a. Four rectangular major face panels, comprising in order a first panel, second panel, third panel and fourth panel, each panel being foldably connected to the next adjacent panel, b. Each of the four major face panels has a pair of panels at opposite ends of said major face panels, comprising in order a first pair of side panels, a second pair of side panels, a third pair of side panels and a fourth pair of side panels, c. Said first pair of side panels being foldably attached to said first major face panel, but being separated or separable from each adjacent member of said second pair of side panels, d. The second pair of side panels are separable from or separated from said second major face panel and foldably attached to each adjacent panel in the third pair of side panels, e. The third pair of side panels are foldably attached to the third major face panel and to said fourth pair of side panels, f. The fourth pair of side panels are separable from or separated from the fourth major face panel, and g. An edge of the fourth major face panel farthest away from the first major face panel has a foldably attached closing panel attached thereto, and at least the first, third and fourth pairs of side panels have openings or openable sections therein.

Many alternatives or variations in the construction may be provided, such as having serrated fold lines to facilitate opening of the assembled container, as by tearing or cutting along a serrated line. The core of the sheet material should be sufficiently strong, of course, to support the roll of sheet material within the container. The rolls, with the core, may weigh 10, 20 30, 50 or even 100 kg. The provision of three side panels in planar parallel alignment provides ample support strength at the sides of the container.

The invention may be considered to be both a container blank and a container formed from the blank wherein the container blank which may be folded to form a container designed to support material wrapped upon a core with ends of the core extending beyond edges of said material comprising: four rectangular major face panels, comprising in order a first panel, second panel, third panel and fourth panel, each panel being foldably secured to the next adjacent panel, each of said four major face panels has a pair of panels at opposite ends of said major face panels, comprising in order a first pair of side panels, a second pair of side panels, a third pair of side panels and a fourth pair of side panels, said first pair of side panels being foldably attached to said first major face panel, but being separated or separable from each adjacent member of said second pair of side panels, said second pair of side panels being separable or separated from said second major face panel and foldably attached to each adjacent panel in said third pair of side panels, said third pair of side panels are foldably attached to said third major face panel and to said fourth pair of side panels, said fourth pair of side panels being separable or separated from said fourth major face panel, and an edge of said fourth major face panel farthest away from said first major face panel having a foldably attached closing panel attached thereto, at least said first, third and fourth pairs of side panels having openings or openable sections therein. Said first, third and fourth pairs of side panels have openings therein which are holes passing entirely through each of said first, third and fourth pairs of panels.

The invention also describes a container comprising the container blank described above which has been folded to place openings of the first, third and fourth pairs of side panels into alignment to form two continuous openings, one at each of a pair of opposite sides on said container, with a core extending through said continuous openings, said core having material wrapped around the core. The container preferably has the sheet material wrapped around said core and forms and edge of sheet material which contacts an interior face of one panel of said first pair of side panels, said contact being at least in part around an opening (the aligned holes) in said interior face. The container blank is folded to place openings of said first, third and fourth pairs of side panels into alignment to form two continuous openings, one at each of a pair of opposite sides on said container, with a core extending through said continuous openings, said core having material wrapped around the core. In a preferred practice of the present invention, the sheet material comprises stretch wrap polymeric film having an adhesive on at least one face of the stretch wrap which faces the core on the wrapped sheet material. The adhesive may be on the interior surface as wrapped, the exterior surface as wrapped, or on both surfaces of the stretch wrap film material. The adhesive may be a pressure-sensitive adhesive material (e.g., an acrylate adhesive, polyurethane adhesive, or polysiloxane adhesive).

What is claimed is:

1. A container blank which can be folded to form a container designed to support material wrapped upon a core with ends of the core extending beyond edges of said material comprising:

a. four rectangular major face panels, comprising in order a first panel, second panel, third panel and fourth panel, each panel being foldably secured to the next adjacent panel, b. each of said four major face panels has a pair of panels at opposite ends of said major face panels, comprising in order a first pair of side panels, a second pair of side panels, a third pair of side panels and a fourth pair of side panels, c. said first pair of side panels being foldably attached to said first major face panel, but being separated or separable from each adjacent member of said second pair of side panels, d. said second pair of side panels being separable or separated from said second major face panel and foldably attached to each adjacent panel in said third pair of side panels, e. said third pair of side panels are foldably attached to said third major face panel and to said fourth pair of side panels, f. said fourth pair of side panels being separable or separated from said fourth major face panel, and g. an edge of said fourth major face panel farthest away from said first major face panel having a foldably attached closing panel attached thereto, at least said first, third and fourth pairs of side panels having openings or openable sections therein.

2. The container blank of claim 1 wherein said first, third and fourth pairs of side panels have openings therein which are holes passing entirely through each of said first, third and fourth pairs of panels.

3. The container blank of claim 1 wherein said closing panel has a pair of locking flaps which extend from said closing panel in a direction parallel to a line formed by foldable attachment of said closing panel and said fourth major face panel.

4. The container blank of claim 1 wherein each panel of said fourth pair of side panels has a locking member extending in a direction away from adjacent third pair of side panels.

5. The container blank of claim 4 wherein a slot capable of receiving said locking members is present between each panel of said second and third pairs of side panels.

6. The container blank of claim 1 wherein said first pair of side panels and said second pair of side panels are movably separated from each other.

7. The container of claim 1 wherein said foldable attachment between said third and fourth pairs of side panels comprises two adjacent foldable lines.

8. The container blank of claim 1 wherein said first, third and fourth pairs of side panels have openings therein which are holes passing entirely through each of said first, third and fourth pairs of panels, said closing panel has a pair of locking flaps which extend from said closing panel in a direction parallel to a line formed by foldable attachment of said closing panel and said fourth major face panel, each panel of said fourth pair of side panels has a locking member extending in a direction away from adjacent third pair of side panels, a slot capable of receiving said locking members is present between each panel of said second and third pairs of side panels, and said first pair of side panels and said second pair of side panels are movably separated from each other.

9. The container of claim 8 wherein said foldable attachment between said third and fourth pairs of side panels comprises two adjacent foldable lines.

10. A container comprising the container blank of claim 1 folded to place openings of said first, third and fourth pairs of side panels into alignment to form two continuous openings, one at each of a pair of opposite sides on said container, with a core extending through said continuous openings, said core having material wrapped around the core.

11. The container of claim 10 wherein sheet material is wrapped around said core and forms an edge of sheet material which contacts an interior face of one panel of said first pair of side panels, said contact being at least in part around an opening in said interior face.

12. The container of claim 10 wherein said material wrapped around said core comprises polymeric sheet material which is capable of telescoping if said core were positioned vertically and said sheet material were not restrained at an edge of said sheet material against telescoping.

13. The container of claim 11 wherein said material wrapped around said core comprises polymeric sheet material which is capable of telescoping if said core were positioned vertically and said sheet material were not restrained at an edge of said sheet material against telescoping.

14. A container comprising the container balnk of claim 7 folded to place openings of said first, third and fourth paris of side panels into alignment to form two continuous openings, one at each of a pair of opposite sides on said container, with a core extending through said continuous openings, said core having material wrapped around the core.

15. A container comprising the container blank of claim 8 folded to place openings of said first, third and fourth pairs of side panels into alignment to form two continuous openings, one at each of a pair of opposite sides on said container, with a core extending through said continuous openings, said core having material wrapped around the core.

16. The container of claim 10 wherein said sheet material comprises stretch wrap polymeric film having an adhesive on at least one face of the stretch wrap which faces the core on the wrapped sheet material.

17. The container of claim 15 wherein said sheet material comprises stretch wrap polymeric film having an adhesive on at least one face of the stretch wrap which faces the core on the wrapped sheet material.

18. The container of claim 15 wherein said sheet material comprises stretch wrap polymeric film having an adhesive on at least one face of the stretch wrap which faces the core on the wrapped sheet material, and said adhesive comprises tackifying agent.

* * * * *